United States Patent [19]

Spahrkäs et al.

[11] 4,211,529

[45] Jul. 8, 1980

[54] CHROME-TANNING

[75] Inventors: Heinrich Spahrkäs; Josef Müller; Ernst Komarek; Wolfhard Luck, all of Leverkusen, Fed. Rep. of Germany

[73] Assignee: Bayer Aktiengesellschaft, Leverkusen, Fed. Rep. of Germany

[21] Appl. No.: 936,279

[22] Filed: Aug. 23, 1978

[30] Foreign Application Priority Data

Sep. 3, 1977 [DE] Fed. Rep. of Germany ..... 2739844

[51] Int. Cl.[2] ..... C14C 3/06; C14C 9/00

[52] U.S. Cl. ..... 8/94.26; 8/94.27; 252/8.57

[58] Field of Search ..... 8/94.26, 94.27; 252/8.57

[56] References Cited

U.S. PATENT DOCUMENTS

| | | | |
|---|---|---|---|
| 3,174,817 | 3/1965 | Spahrkas et al. | 8/94.27 |
| 3,346,323 | 10/1967 | Spahrkas et al. | 8/94.27 |
| 3,656,881 | 4/1972 | Hemwall | 8/94.23 |
| 4,042,321 | 8/1977 | Backer et al. | 8/94.27 |
| 4,101,271 | 7/1978 | Bockelman et al. | 8/94.27 |
| 4,126,413 | 11/1978 | Traubel et al. | 8/94.27 |

*Primary Examiner*—Ronald W. Griffin

*Attorney, Agent, or Firm*—Sprung, Felfe, Horn, Lynch & Kramer

[57] ABSTRACT

In the chrome-tanning of animal skins and hides by pretanning the pickled pelts with chromium (III) salts, followed by full tanning with chromium (III) salts and acid-binding agents, the improvement which comprises effecting full tanning with the reaction of product at least one of formic acid and a formate with a basic chromium (III) sulphate, at least 2 moles of formate plus formic acid being used per mole of $Cr_2O_3$ in the chrome-tanning agent used for full tanning, the total input of chromium oxide being from about 1.0 to 1.8%, based on the weight of the pelts, and tanning being carried out with a liquor volume of at most 100%, based on the weight of the pelts, up to a final pH-value of at least 4.0.

6 Claims, No Drawings

CHROME-TANNING

This invention relates to a process for the chrome-tanning of animal skins and hides with very high utilization of the chrome-tanning agents, in which reaction products of formates and/or formic acid with chromium(III)sulphates are used.

In normal chrome-tanning, approximately one third of the total input of chrome-tanning agent remains unused. Accordingly, there has been no shortage of attempts to improve utilization of the chrome-tanning agent. Over recent years, processes have been developed to enable the residual liquor to be utilized as far as possible (cf. for example U.S. Pat. No. 4,042,321).

Reaction products of formates and/or formic acid with (basic) chromium(III)sulphates have already been used for tanning. In their case, both a reduction and also an increase in the chromium-binding level have been obtained during tanning, depending upon the ratio of formate to $Cr_2O_3$ and upon other parameters, such as for example the age and basicity of the chromium complexes and the temperature and acidity conditions prevailing during tanning.

However, the increases obtained are by no means comparable with those obtainable, for example, with polybasic organic acids or their salts. Accordingly, it was not foreseeable that almost complete utilization of the residual chrome liquors and, at the same time, leather with commercially very good properties would be obtainable by the use in accordance with the invention of reaction products of formates and/or formic acid with chromium(III)sulphates.

In another known chrome-tanning process (cf. H. Bay, Leder- und Hautemarkt 29 (1977), 194), a more uniform distribution and an improvement in the uptake of chromium are obtained by using aldehydes, particularly glutaraldehyde. In this case, a chrome-tanning agent masked with 2 moles of formate per mole of $Cr_2O_3$ is used without preliminary pickling, although tanning agents of this type are not mentioned as advantageous in this process. Apart from the fact that aldehydes have to be used, the leather properties obtained are not good enough.

The present invention provides a chrome-tanning process in which the pickled pelts are pretanned with chromium(III)salts and fully tanned with chromium(III)salts and acid-binding agents, characterized in that full tanning is carried out with reaction products of formates and/or formic acid with (basic) chromium(III)sulphates, at least 2 moles of formate and/or formic acid being used per mole of $Cr_2O_3$ in the chrome-tanning agent used for full tanning, the total input of chromium oxide being from about 1.0 to 1.8%, based on the weight of the pelts, and tanning being carried out with a liquor volume of at most 100%. based on the weight of the pelts (ml/g), up to a final pH-value of at least 4.0.

It has surprisingly been found that the process according to the invention provides for excellent utilization of the residual chrome liquor and that smooth, i.e. less drawn, leathers with a very favorable distribution of chromium throughout their cross-section are obtained. The particular advantage of the process according to the invention lies in the fact that the simple, coordinated process steps enable leather of very good quality to be obtained, even when carried out on a commercial scale, and in the fact that the residual liquors contain less than 1 g per liter of $Cr_2O_3$.

Preferred chromium(III)salts for the pretanning step are chromium(III)sulphates, particularly basic chromium(III)sulphates, or reaction products of hexavalent chromium compounds with organic reducing agents, such as glucose or molasses.

The reaction products of formates and/or formic acid with (basic) chromium(III)sulphates which are used for full tanning are obtained in known manner. Other suitable chromium(III)sulphates are reaction products of hexavalent chromium compounds, sulphuric acid and organic reducing agents, such as glucose and molasses. The reaction products may be produced before use or may even be produced during the full tanning step itself.

It is preferred to use reaction products obtained by treating chromium(III)sulphates with 2 or more moles of formate and/or formic acid per mole of $Cr_2O_3$ in solution with heating, followed by spray drying. Sodium formate, calcium formate or even formic acid, for example, may be used for this purpose.

In one preferred embodiment, powder-form mixtures of basic chromium(III)salts and salts of formic acid are used as the full-tanning agents. These mixtures may be dissolved before use or may even be used as such in powder form, i.e. undissolved.

The molar ratio of formate and/or formic acid to the $Cr_2O_3$ in the chrome-tanning agent used for full tanning should amount to at least 2 moles per mole of $Cr_2O_3$ and, in particular, to at least 3 moles per mole of $Cr_2O_3$. It is best to use from about 3 to about 6 moles of formate and/or formic acid per mole of $Cr_2O_3$ for producing the tanning agents used for full tanning.

Suitable acid-binding agents are, for example, dolomite, alkali metal carbonates, alkali metal bicarbonates, alkaline earth metal carbonates, alkaline earth metal bicarbonates, magnesium oxide or sodium sulphite. Dolomite is preferably used.

The dolomite used is the mineral double salt $CaCO_3.MgCO_3$ which has a CaO-content of from 20 to 40%, preferably from 25 to 35%. and an MgO-content of from 10 to 25%, preferably from 16 to 24% (percentages by weight). The dolomite may be used either on its own or in combination with other acid-binding agents, the dolomite content of the mixtures preferably amounting to at least 10% of the total quantity of acid binding agents used.

The quantity of dolomite used is governed by the basicity of the chromium(III)compounds used for pretanning and full tanning and also by the basicity to which it is intended to take these chromium(III)compounds during tanning; it is also governed by the quantity of other acid binding agents used in the mixture, if any.

Delimed and pickled pelts are used in conventional manner for carrying out the process according to the invention. Sodium chloride/sulphuric acid pickles are preferably used. The chromium(III)salts used for pretanning are best employed in a quantity of at least 0.5% of chromium oxide and more particularly in a quantity of at least 0.8% of $Cr_2O_3$, based on the weight of the pelts. In one preferred embodiment, the pretanning step is carried out in such a way that the skins are actually tanned throughout their entire cross-section.

Full tanning is best carried out in the same bath by adding the chrome-tanning agents according to the invention, preferably in powder form. However, the tanning agents may also be added in the form of a solution. The chrome-tanning agents used for full tanning are preferably added together with the acid-binding agent. In particular, powder-form mixtures of reaction products of formates and/or formic acid with (basic) chromium(III)sulphates and dolomite are used. However, the components may also be individually added. The reaction products of formates and/or formic acid with (basic) chromium(III)sulphates which are used for full tanning may also be used together with the chromium(III)salts used for pretanning. For relatively thick skins, for example cow pelts, however, separate addition is advisable.

In cases where the reaction products of formates and/or formic acid are produced during the actual tanning process, the total amount of chromium required for producing the leather may even be added all at once and the formates and/or formic acid subsequently added, preferably together with the acid-binding agents.

The total input of $Cr_2O_3$ for pretanning and full tanning should be from 1.0 to 1.8%, based on the weight of the pelts, and more particularly from 1.2 to 1.6% of $Cr_2O_3$.

The full tanning step is carried out in an at most 100% liquor and preferably in a 20 to 60% liquor, based on the weight of the pelts. Tanning is carried out in such a way that, on completion of full tanning, the liquor has a pH-value of at least 4.0 and more particularly from 4.4 to 5.5.

Tanning is best carried out in such a way that the pretanning step lasts from 0.5 to 6 hours and, more particularly, from 1 to 4 hours. The full tanning step takes from 3 to 10 hours and, more particularly, from 6 to 8 hours, depending upon the type of skin being tanned.

During the full tanning step, the temperature is increased to at least 35° C. and best to 40° to 50° C.

The process according to the invention is illustrated by the following examples (percentages by weight):

EXAMPLE 1

To produce aniline leather, 1000 kg of cow hides limed in the usual way and splitted 3.2 mm are washed with 100% (based on the split weight) of water at 38° C. for 10 minutes at 9 rpm in a tanning drum (diameter 3 meters, width 2.5 meters). The liquor is drained off, after which the pelts are delimed for 30 minutes with 50% of water at 38° C. containing 3% of ammonium suplhate and 0.7% of sodium bisulphite and bated for 30 minutes with 0.5% of a standard commercial-grade bate. The pH-value of the liquor is 8.0. The cross-section of the pelts no longer produces a red color when tested with phenolphthalein. The pelts are then rinsed for 15 minutes with running water at 22° C., after which the rinsing liquor is completely drained off. For pickling the pelts, 20% of water at 22° C. and 3.5% of sodium chloride are added, followed by druming for 10 minutes, after which 0.7% of sulphuric acid diluted with 7% of water are added and the pelts are pickled with druming for 60 minutes (pH 3.7). 4.6% of a powder-form 33% basic chromium(III)sulphate containing 26% of chromium oxide are added to the pickling float After 1 hour, 2.1% of the chromium(III)salt mixture described below are added, followed by druming for another 8 hours. The final tanning temperature is 40° C., the pH-value of the liquor is 4.9 and the residual liquor contains 0.8 g of chromium oxide per liter. Finishing in the usual way gives leathers having a full, mild feel, a fine smooth grain and a uniform color.

The chromium(III)salt of the mixture is obtained by reacting 2340 parts by weight of a 33% basic chromium(III)sulphate liquor, containing 10% of chromium oxide, with 515 parts by weight of calcium formate and 70 parts by weight of calcium carbonate and filtering off the calcium sulphate formed, followed by spray drying. Of this 50% basic chromium(III)salt containing 32.5% of chromium oxide and 49% of formic acid (about 5 moles of HCOOH per mole of $Cr_2O_3$), 590 parts by weight are mixed with 410 parts by weight of dolomite.

In the following examples, the parts quoted represent parts by weight.

EXAMPLE 2

100 parts of cow hides pretreated in the same way as in Example 1 are pickled in the usual way with sodium chloride, sulphuric acid and 20 parts of water (pH 3.2). 3 parts of a powder-form 33% basic chromium(III)sulphate containing 26% of chromium oxide are introduced into the pickling liquor. After 2 hours, 1.3 parts of the chromium(III)salt mixture described below are added, followed by druming for another 7 hours. The final temperature is 42° C., the final pH-value is 4.6 and the residual liquor contains 0.1 g of $Cr_2O_3$ per liter.

The chromium(III)salt of the mixture is obtained by reacting 2340 parts of 33% basic chromium(III)sulphate liquor, containing 10% of chromium oxide, with 563 parts of calcium formate and 34 parts of calcium carbonate and filtering off the calcium sulphate formed, followed by spray drying. Of this 42% basic chromium(III)salt, containing 32.6% of chromium oxide and 56% of formic acid (about 5.8 moles of HCOOH per mole of $Cr_2O_3$), 534 parts are mixed with 466 parts of dolomite.

EXAMPLE 3

100 parts of cow hides pretreated in the same way as in Example 1 are pickled in the usual way with sodium chloride, formic acid and sulphuric acid and 30 parts of water (pH 3.5). 3 parts of a powder-form 33% basic chromium(III)sulphate, containing 26% of $Cr_2O_3$, are introduced into the pickling liquor. After 1 hour, 1.8 parts of the chromium(III)salt mixture described below are added, followed by druming for another 8 hours. The final temperature is 43° C., the final pH-value is 4.5 and the residual liquor contains 0.3 g of $Cr_2O_3$ liter.

The chromium(III)salt of the mixture is obtained by reacting 2340 parts of 33% basic chromium(III)sulphate liquor, containing 10% of $Cr_2O_3$, with 322 parts of calcium formate and 70 parts of calcium carbonate and filtering off the calcium sulphate formed, followed by spray drying. Of this 42% basic chromium(III)salt, containing 34.4% of $Cr_2O_3$ and 33.4% of HCOOH (about 3.2 moles of HCOOH per mole of $Cr_2O_3$), 663 parts are mixed with 337 parts of dolomite.

EXAMPLE 4

100 parts of cow hides pretreated in the same way as in Example 1 are pickled in the usual way with sodium chloride, sulphuric acid and 30 parts of water (pH 3.0). 4 parts of a powder-form 33% basic chromium(III)sulphate, containing 26% of $Cr_2O_3$, are introduced into the pickling liquor. After 1 hour, 2.1 parts of the chromium(III)salt mixture described below are added, followed by druming for another 9 hours. The final temperature is 40° C., the final pH-value is 4.6 and the residual liquor contains 0.5 g of $Cr_2O_3$ per liter.

The chromium(III)salt of the mixture is obtained by reacting 2340 parts of 33% basic chromium(III)sulphate liquor, containing 10% of $Cr_2O_3$, with 466 parts of calcium formate and 106 parts of calcium carbonate and filtering off the calcium sulphate formed, followed by spray drying. Of this 58% basic chromium(III)salt, containing 35.4% of $Cr_2O_3$ and 49% of HCOOH (about 4.5 moles of HCOOH per mole of $Cr_2O_3$), 660 parts are mixed with 340 parts of dolomite.

EXAMPLE 5

100 parts of cow hides pretreated in the same way as in Example 1 are pickled in the usual way with sodium chloride, sulphuric acid and 30 parts of water (pH 3.2). 4.5 parts of a powder-form 42% basic chromium(III)-sulphate obtained by reducing sodium dichromate with glucose and containing 26% of $Cr_2O_3$ are introduced into the pickling liquor. After 1 hour, 1.9 parts of the chromium(III)salt mixture described below are added, followed by druming for another 9 hours. The final temperature is 47° C., the final pH-value is 4.8 and the residual liquor contains 0.6 g of $Cr_2O_3$ per liter.

The chromium(III)salt mixture consists of 640 parts of the chromium(III)salt, as described in Example 4, and 360 parts of dolomite.

EXAMPLE 6

100 parts of cow hides pretreated in the same way as in Example 1 are pickled in the usual way with sodium chloride, sulphuric acid and 30 parts of water (pH 3.0). 3.1 parts of a powder-form 33% basic chromium(III)-sulphate containing 26% of $Cr_2O_3$ are introduced into the pickling liquor. After 1 hour, 3.5 parts of the chromium(III)salt mixture described hereinbelow are added, followed by druming for another 9 hours. The final temperature is 45° C., the final pH-value is 4.7 and the residual liquor contains 0.3 g of $Cr_2O_3$ per liter.

The chromium(III)salt mixture consists of 550 parts of 33% basic chromium(III)sulphate, containing 26% of $Cr_2O_3$, 223 parts of sodium formate and 227 parts of dolomite.

EXAMPLE 7

100 parts of cow hides pretreated in the same way as in Example 1 are pickled in the usual way with sodium chloride, sulphuric acid and 30 parts of water (pH 3.3). 5.8 parts of a 33% basic chromium(III)sulphate liquor containing 18% of $Cr_2O_3$ and diluted with 10 parts of water are introduced into the pickling liquor. After 1 hour, 1.8 parts of the chromium(III)salt mixture described in Example 1 are added, followed by druming for another 9 hours. The final temperature is 43° C., the final pH-value is 4.7 and the residual liquor contains 0.4 g of $Cr_2O_3$ per liter.

EXAMPLE 8

100 parts of cow hides pretreated in the same way as in Example 1 are pickled in the usual way with sodium chloride, sulphuric acid and 20 parts of water (pH 3.3). 4.6 parts of a powder-form 33% basic chromium(III)-sulphate, containing 26% of $Cr_2O_3$, are introduced into the pickling liquor. After 1 hour, 1.2 parts of the chromium(III)salt described in Example 1, containing 32.5% of $Cr_2O_3$ and 49% of HCOOH, are added. After 15 minutes, 1 part of sodium carbonate is dissolved in 10 parts of water and continuously added over a period of 2 hours, followed by druming for another 6 hours. The final temperature is 45° C., the final pH-value is 4.7 and the residual liquor contains 0.7 g of $Cr_2O_3$ per liter.

EXAMPLE 9

100 parts of cow pelts pretreated in the same way as in Example 1 are pickled in the usual way with sodium chloride, sulphuric acid and 40 parts of water (pH 3.8). 4.6 parts of a powder-form 33% basic chromium(III)-sulphate containing 26% of $Cr_2O_3$ are introduced into the pickling liquor. After 1 hour, 2 parts of the chromium(III)salt mixture described below are added, followed by milling for another 8 hours. The final tanning temperature is 42° C., the final pH-value is 4.9 and the residual liquor contains 0.6 g of $Cr_2O_3$ per liter.

The chromium(III)salt mixture consists of 638 parts of the chromium(III)salt, as described in Example 1, 284 parts of dolomite and 78 parts of magnesium oxide.

EXAMPLE 10

100 parts of unsplit cow pelts pretreated in the same way as in Example 1 are pickled in the usual way with sodium chloride, sulphuric acid and 20 parts of water (pH 2.4). 4.6 parts of a powder-form 33% basic chromium(III)sulphate, containing 26% of $Cr_2O_3$, are introduced into the pickling liquor. After 4 hours, 2.1 parts of the chromium(III)salt mixture described in Example 1 are added, followed by druming for another 8 hours. The final temperature is 45° C., the final pH-value is 4.8 and the residual liquor contains 1.1 g of $Cr_2O_3$ per liter. The leathers are split after chrome-tanning and finished in the usual way.

EXAMPLE 11

100 parts of cow pelts pretreated in the same way as in Example 1 are pickled in the usual way with sodium chloride, sulphuric acid and 30 parts of water (pH 3.5). 6.2 parts of a powder form 33% basic chromium(III)sulphate containing 26% of $Cr_2O_3$ are introduced into the pickling liquor. After 1 hour, 0.9 part of sodium formate, 0.85 part of dolomite and 0.14 part of soda are added, followed by drumming for another 8 hours. The final temperature is 46° C., the final pH value is 4.8 and the residual liquor contains 0.5 g of $Cr_2O_3$ per liter.

It will be appreciated that the instant specification and examples are set forth by way of illustration and not limitation, and that various modifications and changes may be made without departing from the spirit and scope of the present invention.

What we claim is:

1. In the chrome-tanning of animal skins and hides by pretanning the pickled pelts with chromium(III)salts and acid-binding agents and thereafter full tanning, the improvement which comprises effecting full tanning with the reaction product of at least one of formic acid and a formate with a basic chromium (III) sulphate, at least 2 moles of formate plus formic acid being used per mole of $Cr_2O_3$ for full tanning, the total input of chromium oxide being from about 1.0 to 1.8%, based on the weight of the pelts, and tanning being carried out with a liquor volume of at most 100%, based on the weight of the pelts, up to a final pH-value of at least 4.0.

2. A process as claimed in claim 1, wherein the acid-binding agent comprises dolomite.

3. A process as claimed in claim 1, wherein the chromium(III)salts used for full tanning are added together with the chromium(III)salts used for pretanning.

4. A process as claimed in claim 1, wherein the reaction product of formate or formic acid with basic chromium(III)sulphate is produced in the course of full tanning.

5. A process as claimed in claim 1, wherein the tanning is carried out up to a final pH value of from 4.4 to 5.5.

6. A tanning mixture consisting of the reaction product of at least one of formic acid and a formate with a basic chromium(III)sulphate and an acid-binding agent, the mixture containing at least 2 moles of formate plus formic acid per mole of $Cr_2O_3$.

* * * * *